US009711855B2

(12) United States Patent
Sonoda et al.

(10) Patent No.: US 9,711,855 B2
(45) Date of Patent: Jul. 18, 2017

(54) MULTIBAND ANTENNA AND WIRELESS DEVICE

(71) Applicant: Asahi Glass Company, Limited, Tokyo (JP)

(72) Inventors: Ryuta Sonoda, Tokyo (JP); Koji Ikawa, Tokyo (JP); Toshiki Sayama, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 14/747,178

(22) Filed: Jun. 23, 2015

(65) Prior Publication Data

US 2015/0288066 A1 Oct. 8, 2015

Related U.S. Application Data

(63) Continuation of application No. PCT/JP2013/084964, filed on Dec. 26, 2013.

(30) Foreign Application Priority Data

Dec. 28, 2012 (JP) ..... 2012-289053

(51) Int. Cl.
*H01Q 5/50* (2015.01)
*H01Q 9/42* (2006.01)
(Continued)

(52) U.S. Cl.
CPC ..... *H01Q 5/50* (2015.01); *H01Q 1/22* (2013.01); *H01Q 1/243* (2013.01); *H01Q 1/48* (2013.01);
(Continued)

(58) Field of Classification Search
None
See application file for complete search history.

(56) References Cited

U.S. PATENT DOCUMENTS 6,600,449 B2 * 7/2003 Onaka ..... H01Q 1/22 343/700 MS
7,106,256 B2 9/2006 Watanabe et al.
(Continued)

FOREIGN PATENT DOCUMENTS

CN 1496595 A 5/2004
CN 101095262 A 12/2007
(Continued)

OTHER PUBLICATIONS

U.S. Appl. No. 14/790,472, filed Jul. 2, 2015, Sonoda, et al.
(Continued)

*Primary Examiner* — Howard Williams
(74) *Attorney, Agent, or Firm* — Oblon, McClelland, Maier & Neustadt, L.L.P.

(57) ABSTRACT

A multiband antenna includes a feeding element connected to a feeding point, a radiating element functioning as a radiating conductor, the radiating element being positioned apart from the feeding element and fed with electric power by electromagnetically coupling to the feeding element, a ground plane, and a non-feeding element being positioned close to the radiating element and connected to the ground plane via a reactance element. The reactance element has a reactance that causes the multiband antenna to match with a frequency other than a resonance frequency of a resonance mode of the radiating element.

20 Claims, 5 Drawing Sheets

(51) Int. Cl.

| | |
|---|---|
| ***H01Q 1/22*** | (2006.01) |
| ***H01Q 1/24*** | (2006.01) |
| ***H01Q 1/50*** | (2006.01) |
| ***H01Q 1/48*** | (2006.01) |
| ***H01Q 5/10*** | (2015.01) |
| ***H01Q 5/328*** | (2015.01) |
| ***H01Q 9/38*** | (2006.01) |

(52) U.S. Cl.

CPC ..... *H01Q 1/50* (2013.01); *H01Q 5/10* (2015.01); *H01Q 5/328* (2015.01); *H01Q 9/38* (2013.01); *H01Q 9/42* (2013.01)

(56) References Cited

U.S. PATENT DOCUMENTS

| | | | | |
|---|---|---|---|---|
| 7,119,743 | B2 * | 10/2006 | Iguchi | H01Q 1/36 343/700 MS |
| 7,176,837 | B2 | 2/2007 | Sonoda et al. | |
| 7,365,685 | B2 | 4/2008 | Takeuchi et al. | |
| 7,675,469 | B2 * | 3/2010 | Ohba | H01Q 5/385 343/702 |
| 2005/0052334 | A1 | 3/2005 | Ogino et al. | |
| 2005/0119035 | A1 | 6/2005 | Miyano et al. | |
| 2007/0046542 | A1 | 3/2007 | Andrenko et al. | |
| 2007/0052599 | A1 | 3/2007 | Shimizu et al. | |
| 2007/0069956 | A1 | 3/2007 | Ozkar | |
| 2007/0069958 | A1 | 3/2007 | Ozkar | |
| 2007/0268190 | A1 | 11/2007 | Huynh | |
| 2008/0266190 | A1 | 10/2008 | Ohba et al. | |
| 2009/0051611 | A1 | 2/2009 | Shamblin et al. | |
| 2010/0026602 | A1 | 2/2010 | Hotta et al. | |
| 2010/0164812 | A1 | 7/2010 | Ganeshan et al. | |
| 2011/0102272 | A1 * | 5/2011 | Wong | H01Q 1/243 343/702 |
| 2015/0130669 | A1 | 5/2015 | Sonoda et al. | |
| 2016/0043467 | A1 * | 2/2016 | Desclos | H01Q 5/328 343/745 |

FOREIGN PATENT DOCUMENTS

| | | | |
|---|---|---|---|
| JP | 2008-278219 | A | 11/2008 |
| JP | 2009-510900 | A | 3/2009 |
| JP | 2009-510901 | A | 3/2009 |
| JP | 2009-538049 | A | 10/2009 |
| JP | 2010-034906 | A | 2/2010 |
| WO | WO 2005/069439 | A1 | 7/2005 |
| WO | WO 2007/043150 | A1 | 4/2007 |
| WO | WO 2009/026304 | A1 | 2/2009 |

OTHER PUBLICATIONS

A. Kurs, et al., "Wireless Power Transfer via Strongly Coupled Magnetic Resonances", Science Express, vol. 317, No. 5834, pp. 83-86, Jul. 6, 2007.

International Search Report issued Mar. 25, 2014 in PCT/JP2013/084964, filed Dec. 26, 2013.

* cited by examiner

MULTIBAND ANTENNA AND WIRELESS DEVICE

CROSS-REFERENCE TO RELATED APPLICATION

This application is a U.S. continuation application filed under 35 USC 111(a) claiming benefit under 35 USC 120 and 365(c) of PCT application JP2013/084964, filed Dec. 26, 2013, which claims priority to Application Ser. No. 2012-289053, filed in Japan on Dec. 28, 2012. The foregoing applications are hereby incorporated herein by reference.

TECHNICAL FIELD

The present invention relates to a multiband antenna and a wireless device that utilizes a radiating element that resonates at integral multiples of a resonance frequency of a fundamental mode of the radiating element.

BACKGROUND ART

In Patent Documents 1 and 2, there are proposed a multiband antenna that uses a high order mode having a radiating element that resonates at integral multiples of a resonance frequency of a fundamental mode of the radiating element. Patent Document 3 proposes a multiband antenna using a high order mode in which a bandwidth of a resonance frequency of each resonance mode can be adjusted independently.

RELATED ART DOCUMENT

Patent Document

Patent Document 1: Japanese National Publication of International Patent Application No. 2009-510901

Patent Document 2: Japanese National Publication of International Patent Application No. 2009-538049

Patent Document 3: Japanese National Publication of International Patent Application No. 2009-510900

DISCLOSURE OF THE INVENTION

Problems to be Solved by the Invention

However, with the conventional multiband antenna using high order modes, it is difficult to add a new resonance characteristic in-between resonance frequencies of preexisting resonance modes without affecting the resonance characteristics of each of the preexisting resonance modes. An object according to an embodiment of the present invention is to provide a multiband antenna and a wireless device that can be added with a new resonance characteristic without affecting the resonance characteristics of each of the preexisting resonance modes.

Means of Solving the Problems

In order to achieve the above-described object, an embodiment of the present invention provides a multiband antenna including a feeding element connected to a feeding point, a radiating element functioning as a radiating conductor, the radiating element being positioned apart from the feeding element and fed with electric power by electromagnetically coupling to the feeding element, a ground plane, and a non-feeding element being positioned close to the radiating element and connected to the ground plane via a reactance element. The reactance element has a reactance that causes the multiband antenna to match with a frequency other than a resonance frequency of a resonance mode of the radiating element.

EMBODIMENTS FOR CARRYING OUT THE INVENTION

Figure 1:
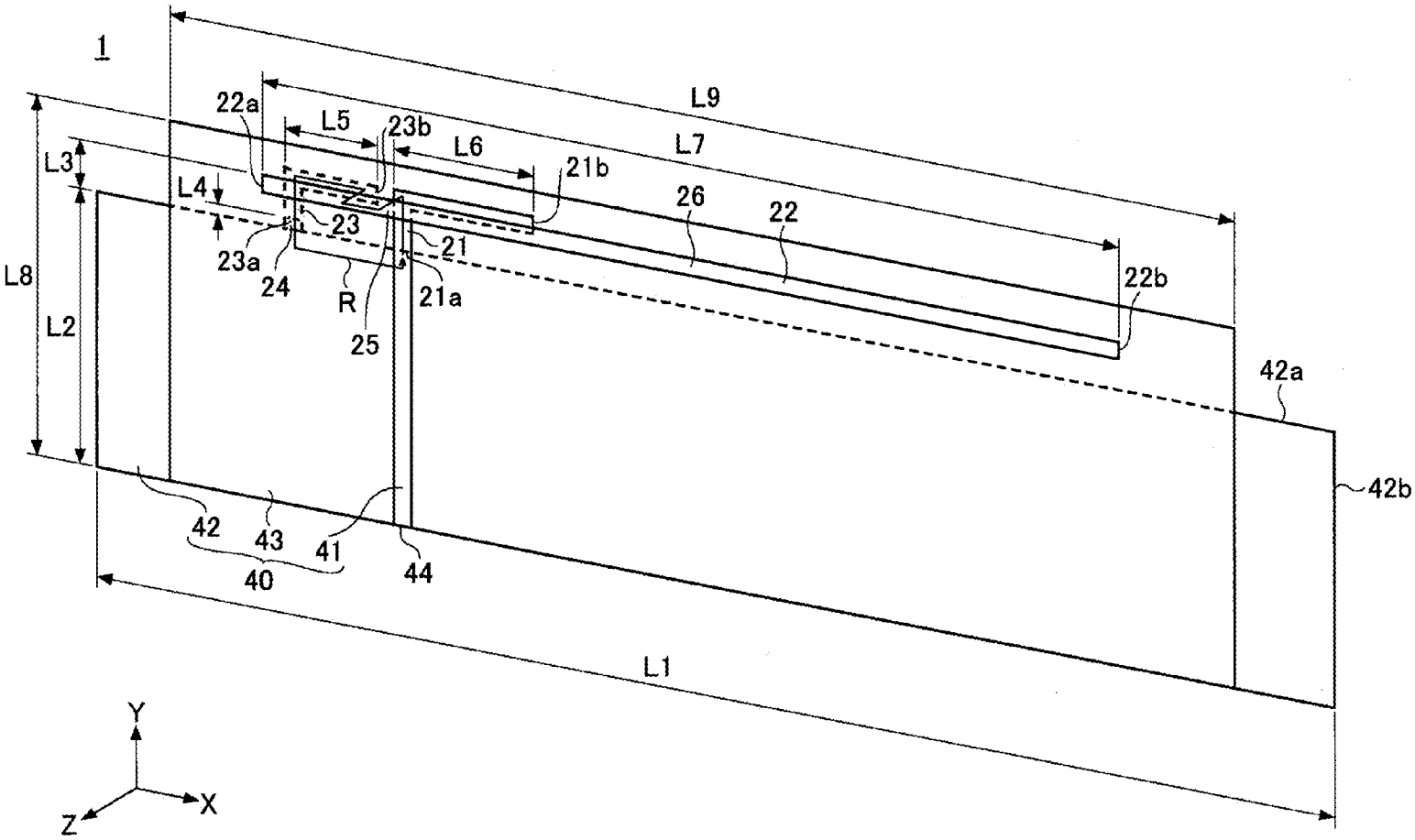
FIG. 1 is a perspective view illustrating an analytic model of a multiband antenna according to an embodiment of the present invention.

FIG. 1 is a perspective view of a simulation model illustrated on a computer for analyzing an operation of a multiband antenna 1 according to an embodiment of the present invention. A Microwave Studio (Registered Trademark, CST Inc.) is used as an electromagnetic simulator. The multiband antenna 1 is a multiband antenna that uses a high order mode. The multiband antenna 1 includes a feeding element 21, a radiating element 22, a ground plane 42, and a non-feeding element 23.

The feeding element 21 is a linear conductor that is connected to a feeding point 44 to feed electric power to the radiating element 22. FIG. 1 illustrates an example in which an end part 21*a* of the feeding element 21 formed on a surface of a resin substrate 43 is connected to a strip conductor 41 of a micro-strip line 40 to be connected to the feeding point via the strip conductor 41 of the micro-strip line 40.

The micro-strip line 40 includes the resin substrate 43, the ground plane 42 provided on one surface of the resin substrate 43, and a linear strip conductor 41 provided on another surface of the resin substrate 43 opposite of the one surface of the resin substrate 43. The resin substrate 43 may be a substrate on which a feeding circuit (e.g., integrated circuit such as an IC chip) is mounted to be connected to the strip conductor 41 via the feeding point 44. FIG. 1 illustrates a rectangular resin substrate 43 and a rectangular ground plane 42 being provided extending on an X-Y plane. In the example of FIG. 1, the feeding element 21 is provided on the same surface as the strip conductor 41, and a boundary between the feeding element 21 and the strip conductor 41 is an edge part 42*a* of the ground plane 42.

In the example of FIG. 1, the feeding element 21 is formed having an L-shape. The feeding element 21 includes a straight-linear conductor that is orthogonal to the edge part 42*a* of the ground plane 42 and extends in parallel with the Y-axis. In the example of FIG. 1, the feeding element 21 is formed by being extended in a Y-axis direction from the end point 21*a* and then being bent in an X-axis direction to extend in the X-axis direction from the end point 21*b*.

The radiating element 22 is an antenna conductor functioning as an antenna to which electric power is fed by way of the feeding element 21. In the example of FIG. 1, the radiating element 22 includes a straight linear conductor that extends from an end part 22*a* to an end part 22*b* and runs in parallel with the edge part 42*a* in the X-axis direction. The feeding element 21 is preferred to be arranged so that a portion thereof extends in a direction separating from the ground plane 42 whereas the radiating element 22 is preferred to be arranged so that a portion thereof extends along the edge part 42*a* or the edge part 42*b* of the ground plane 42. This arrangement allows, for example, the directivity of the multiband antenna 1 to be easily controlled.

The radiating element 22 is a linear conductor arranged a predetermined space apart from the feeding element 21 and electromagnetically coupled to the feeding element 21. Electric power is fed to the radiating element 22 at a feeding part 25 by way of the feeding element 21. The electric power is fed to the radiating element 22 by electromagnetic coupling without contact between the radiating element 22 and the feeding element 21. By feeding electric power in this manner, the radiating element 22 functions as a radiating conductor of the multiband antenna 1. In a case where the radiating element 22 is a linear conductor connecting two points as illustrated in FIG. 1, a resonance current (distribution) that is the same as that of a half wavelength dipole antenna is formed on the radiating element 22. That is, the radiating element 22 functions as a dipole antenna that resonates at a half wavelength of a predetermined frequency (hereinafter also referred to as "dipole mode"). Although not illustrated in the drawings, the radiating element 22 may be a loop conductor that forms a quadrangular shape on a linear conductor. In the case where the radiating element 22 is a loop conductor, a resonance current (distribution) that is the same as that of a loop antenna is formed on the radiating element 22. That is, the radiating element 22 functions as a loop antenna that resonates at one wavelength of a predetermined frequency (hereinafter also referred to as "loop mode").

The term "electromagnetic coupling" refers to coupling that uses a resonating phenomenon of an electromagnetic field and is described in, for example, a non-patent document "Wireless Power Transfer Via Strongly Coupled Magnetic Resonances" (A. Kurs et al., Science Express, Vol. 317, No. 5834, pp. 83-86, July 2007). The electromagnetic coupling (also referred to as "electromagnetic field resonance coupling") is a technology in which resonators that resonate to the same frequency are placed close to each other so that energy is transferred from one resonator to another resonator by the coupling of near fields (non-radiative fields) generated between the resonators when one of the resonators is resonated. Further, electromagnetic coupling also means coupling of electric or magnetic fields in a high frequency except for capacitive coupling and electromagnetic induction coupling. It is, however, to be noted that "except for capacitive coupling and electromagnetic induction coupling" does not mean that capacitive coupling or electromagnetic induction coupling is completely eliminated but means that capacitive coupling or electromagnetic induction coupling is very small to the extent having very little influence. The medium between the feeding element 21 and the radiating element 22 may be, for example, air or a dielectric such as glass or resin. It is preferable to avoid placing a conductive material/member such as a ground plane or a display between the feeding element 21 and the radiating element 22.

By electromagnetically coupling the feeding element 21 and the radiating element 22, a strong structure that is resistant to shock can be obtained. That is, by using electromagnetic coupling between the feeding element 21 and the radiating element 22, electric power can be fed from the feeding element 21 to the radiating element 22 without physical contact between the feeding element 21 and the radiating element 22. Therefore, compared to a contact-feeding type that requires physical contact, a structure that is strong against shock can be obtained.

Further, compared to a case of feeding electric power by capacitive coupling, feeding electric power by electromagnetic coupling prevents the actual gain (antenna gain) of the multiband antenna 1 at the operating frequency from decreasing with respect to changes of separation distance (coupling distance) between the feeding element 21 and the radiating element 22. In this embodiment, "actual gain" refers to an amount calculated according to the "antenna's radiation efficiency×return loss" and is defined as the efficiency of the antenna with respect to input electric power. Therefore, the electromagnetic coupling between the feeding element 21 and the radiating element 22 increases the degree of freedom of arranging the positions of the feeding element 21 and the radiating element 22 and achieves a high positional robustness. The term "high positional robustness" refers to a property in which the change of position or the like between the feeding element 21 and the radiating element 22 has little influence on the actual gain of the multiband antenna 1. Further, because the degree of freedom of arranging the positions of the feeding element 21 and the radiating element 22 is high, the space required for setting the multiband antenna 1 can be easily reduced. Further, owing to the use of electromagnetic coupling, electric power can be fed to the radiating element 22 by using the feeding element 21 and not having to use additional components such as a capacitance plate. Therefore, compared to feeding electric power by capacitive coupling, power feeding can be achieved with a simpler configuration.

Further, in the embodiment illustrated in FIG. 1, the feeding part 25 that is a part where electric power is fed from the feeding element 21 to the radiating element 22 is to be located in a part(s) other than a center part 26 between one end part 22*a* of the radiating element 22 and another end part 22*b* of the radiating element 22 (i.e., a part between the center part 26 and the one end part 22*a* or a part between the center part 26 and the other end part 22*b*). Thus, by positioning the feeding element 25 in a part of the radiating element 22 other than a part where impedance is lowest in a resonance frequency of a fundamental mode of the radiating element 22 (in this embodiment, center part 26 of the radiating element 22), impedance matching of the multiband antenna 1 can be easily performed. The feeding part 25 is defined as a conductive part of the radiating element 22 that is closest to the end part 21*a* of the feeding element 21 in a case where the radiating element 22 and the feeding element 21 are positioned closest to each other.

In a case where the multiband antenna 1 is in a dipole mode, the impedance of the radiating element 22 becomes higher the farther away from the center part 26 in the direction of the first end part 22*a* or the other end part 22*b*. Even when there is some degree of change of impedance between the feeding element 21 and the radiating element 22 in a case of performing coupling by electromagnetic coupling in a high impedance, the change has little effect as long as the electromagnetic coupling is performed in an impedance that is no less than a predetermined high impedance. In order to facilitate matching, it is preferable for the feeding part 25 of the radiating element 22 to be positioned in a part of the radiating element 22 having high impedance.

Thus, in order to facilitate impedance matching of the multiband antenna 1, the feeding part 25 is preferred to be positioned in a part of the radiating element 22 no less than ⅛ (preferably no less than ⅙, and more preferably no less than ¼ of the entire length of the radiating element 22 from a part of the radiating element 22 having lowest impedance in a case of a resonance frequency of a fundamental mode. In the example of FIG. 1, the entire length of the radiating element 22 corresponds to "L7", and the feeding part 25 is positioned toward the one end part 22*a* from the center part 26.

Figure 2:
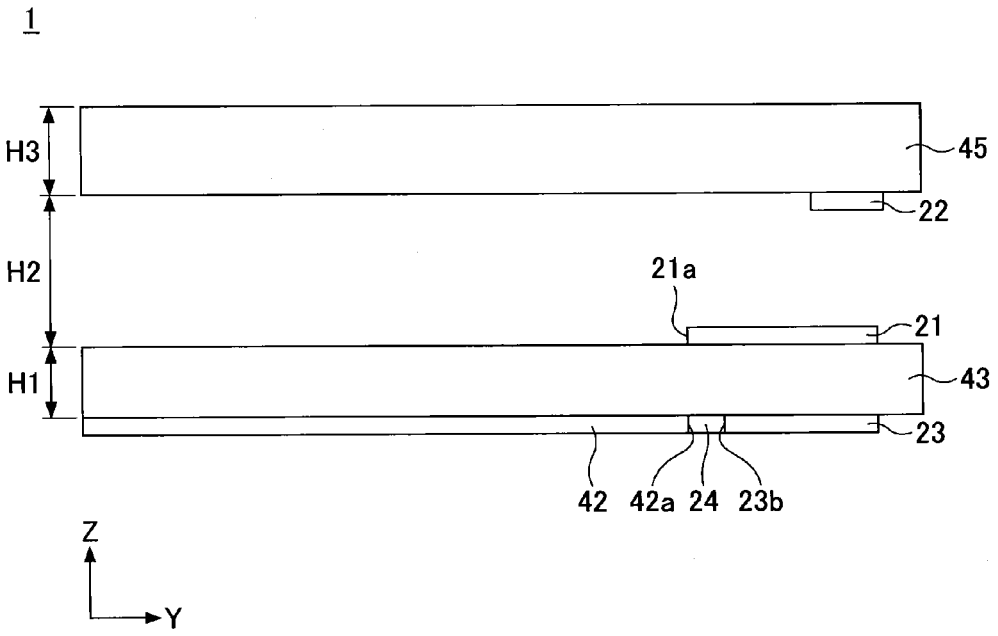
FIG. 2 is schematic diagram illustrating a positional relationship of each element of a multiband antenna according to an embodiment of the present invention.

FIG. 2 is a schematic diagram illustrating a positional relationship among the elements of the multiband antenna 1 with respect to the Z axis direction. As illustrated in FIG. 2, for example, the radiating element 22 that is provided in a resin substrate 45 facing a resin substrate 43 is separated a distance H2 from the resin substrate 43. Although the radiating element 22 is positioned on a surface of the resin substrate 45 on the side facing the feeding element 21, the radiating element 22 may be positioned on the resin substrate 45. Alternatively, the radiating element 22 may be positioned on a surface of the resin substrate 45 on a side opposite of the side facing the feeding element 21 or on a side surface of the resin substrate 45.

It is to be noted that the resin substrate 45 is omitted from FIG. 1 and the strip conductor 41 is omitted from FIG. 2 for better viewing of the drawings.

The non-feeding element 23 is a linear conductor that is provided close to the radiating element 22 and connected to the ground plane 42 by way of the reactance element 24 as illustrated in FIG. 1. In the embodiment of FIG. 1, the non-feeding element 23 includes an end part 23*a* that extends in the Y-axis direction and bent in the X-axis direction to further extend to another end part 23*b* in the X-axis direction. Although the non-feeding element 23 is provided on the same plane as the ground plane 42 of the resin substrate 43 in the embodiment of FIG. 2, the non-feeding element 23 may be provided on the same plane as the feeding element 21. In a case where the non-feeding element 23 is provided on the same plane as the feeding element 21, the non-feeding element 23 is connected to the ground plane 42 by way of a via. Further, in a case where the resin substrate 43 is a multilayer substrate, the non-feeding element 23 may be provided inside a layer of the resin substrate 43.

The non-feeding element 23 is positioned away from the radiating element 22 at a distance allowing high frequency coupling between the non-feeding element 23 and the radiating element 22. The high frequency coupling between the non-feeding element 23 and the radiating element 22 may be capacitive coupling, electromagnetic coupling, or electric field coupling. For example, in a case where "$\lambda_0$" is the vacuum wavelength of a resonance frequency of a fundamental mode of the radiating element 22, the shortest distance between the non-feeding element 23 and the radiating element 22 is preferably less than or equal to "$0.2\times\lambda_0$" from the standpoint of achieving stable high frequency coupling. Further, the non-feeding element 23 can attain a similar effect by having a portion that extends toward a direction separating from the ground plane 42 and a portion superposing the radiating element 22 from a plan view.

It is to be noted that the shortest distance between the non-feeding element 23 and the radiating element 22 is a direct distance between the closest parts of the non-feeding element 23 and the radiating element 22. Further, the non-feeding element 23 and the radiating element 22 may or may not intersect with each other from a Z-direction view as long as high frequency coupling between the non-feeding element 23 and the radiating element 22. In a case where the non-feeding element 23 and the radiating element 22 intersect from a Z-direction view, the intersecting angle between the non-feeding element 23 and the radiating element 22 may be discretionarily set.

The reactance element 24 includes a reactance that allows the multiband antenna 1 to match with a frequency other than the resonance frequency of the resonance mode of the radiating element 22. For example, the reactance element 24 has a reactance that allows the multiband antenna 1 to match with a frequency between the resonance frequencies of two closest resonance modes of the radiating element 22, so that the multiband antenna 1 can perform impedance matching. For example, the frequency between the resonance frequencies of two closest resonance modes of the radiating element 22 may be a frequency between the resonance frequency of the fundamental mode and the resonance frequency of the second order mode (a frequency that is two times the resonance frequency of the fundamental mode).

With the multiband antenna 1, current is to flow through a loop R including the feeding element 21, the radiating element 22, the non-feeding element 23, the reactance element 24, and the ground plane 42. Thus, the feeding element 21, the radiating element 22, the non-feeding element 23, the reactance element 24, and the ground plane 42 are to be arranged to form the loop R in an order of the feeding element 21, the radiating element 22, the non-feeding element 23, the reactance element 24, and the ground plane 42. The loop R illustrated in FIG. 1 is one example of a route throughwhich current flows. A predetermined reactance of the reactance element 24 causes the loop R to resonate in the frequency between the two resonance frequencies of the radiating element 22. Although the specific reactance differs depending on the resonance frequencies of the resonance modes, the reactance is preferably greater than or equal to 8 nH and less than or equa. no greater than 100 nH in a case of resonating the loop R, for example, 1 GHz to 2 GHz.

The multiband antenna 1 has a configuration in which the non-feeding element 23 (being connected to the ground plane 42 via the reactance element 24 having the above-described reactance) is positioned close to the radiating element 22 that causes electromagnetic coupling with the feeding element 21. Owing to this configuration, a new resonance property of resonating between the fundamental mode and the second order mode of the radiating element 22 can be added without affecting the preexisting resonance property of each resonating mode of the radiating element 22.

The reactance element 24 is an element installed in a gap between the non-feeding element 23 and the ground plane 42. The number of reactance elements 24 provided may be one or more. Further, the reactance element 24 may include only a single inductance element. Alternatively, the reactance element 24 may include both an inductance element and a capacitance element. Further, the inductance element and the capacitance element may be connected in series or in parallel.

The capacitance element included in the reactance element 24 may be used to adjust the matching between, for example, the multiband antenna 1 and a feeding circuit to be connected to the feeding element 21 via the feeding point 44.

Further, a variable reactance element may be used as the reactance element 24 to electrically adjust the resonance frequency or electrically match the impedance.

In a case where "Le21" is the electrical length for providing the fundamental mode of the resonance of the feeding element 21, "Le22" is the electrical length for providing the fundamental mode of the resonance of the radiating element 22, and "λ" is the wavelength of the feeding element 21 or the radiating element 22 in a resonance frequency "f" of the fundamental mode of the radiating element 22, it is preferable that "Le21" is less than or equal to (3/8)·λ. In addition, it is preferable that "Le22" is greater than or equal to (3/8)·λ but less than or equal to (5/8)·λ when the fundamental mode of the resonance of the radiating element 22 is a dipole mode and that "Le22" is greater than or equal to "7/8)·λ," but less than or equal to "(9/8)·λ" when the fundamental mode of the resonance of the radiating element 22 is a loop mode.

The electrical length Le21 can form a resonating current (distribution) on the feeding element 21 and the ground plane 42 by forming the ground plane 42 in a manner that its edge part 42*a* is arranged along the radiating element 22 and causing an interaction between the feeding element 21 and the edge part 42*a* of the ground plane 42. Therefore, the electrical length Le21 of the feeding element 21 has no particular limit as long as the electrical length Le21 enables the feeding element 21 to physically achieve electromagnetic field coupling with the radiating element 22. It is to be noted that the achieving of the electromagnetic coupling (electromagnetic field coupling) is a state where the impedance of the multiband antenna 1 is matched. Further, in this state where the electromagnetic coupling is achieved, the electrical length of the feeding element 21 need not be designed in accordance with the resonance frequency of the radiating element 22 but may be freely designed as a radiating conductor. Therefore, it is easy to increase the frequencies of the multiband antenna 1. Further, it is preferable for the edge part 42*a* of the ground plane 42 to have an electrical length to be greater than or equal to (1/4)·λ of a designed frequency (resonance frequency f) when added with the electrical length of the feeding element 21.

In a case where the feeding element 21 does not include a matching circuit or the like, the physical length L21 of the feeding element 21 is determined according to "$\lambda_{g1}=\lambda_0 \cdot k_1$" in which "$\lambda_0$" indicates the vacuum wavelength of the resonance frequency of the fundamental mode of the radiating element 22 and "$k_1$" indicates the shortening rate of wavelength shortening caused by the environment in which the multiband antenna 1 is installed. In this example, "$k_1$" is a value calculated according to, for example, the dielectric constant, the magnetic permeability, the thickness, and the resonance frequency of the medium (environment) of the dielectric material including the feeding element 21 (e.g., the actual dielectric constant (∈r1), and the actual magnetic permeability ($\mu r_1$). That is, "L21" is less than or equal to $(3/8)\cdot\lambda_{g1}$. The shortening rate may be obtained by calculation based on the above-described physicality and/or by actual measurement. For example, the resonance frequency of a target element being placed in an environment for measuring the shortening rate is measured. Then, the resonance frequency of the same element as the target element is measured in a state where the same element is placed in an environment in which the shortening rate of a given frequency is already known. Then, the shortening rate can be calculated according to the difference between the measure resonance frequencies.

The physical length L21 of the feeding element 21 is a physical length for providing the electrical length. In an ideal case where no other element is included in the feeding element 21, the physical length L21 of the feeding element 21 is equal to Le21. In a case where the feeding element 21 includes a matching circuit, the physical length L21 of the feeding element 21 is preferred to exceed 0 but be less than or equal to Le21. The feeding length L21 of the feeding element 21 may be short (size-reduced) by using a matching circuit such as an inductor.

In a case where the fundamental mode of the resonance of the radiating element 22 is a dipole mode (a case where the radiating element is a linear conductor in which both of its ends are open ends), the electrical length Le22 of the radiating element 22 is preferably greater than or equal to (3/8)·λ and less than or equal to (5/8)·λ, more preferably, greater than or equal to (7/16)·λ and less than or equal to (9/16)·λ, and yet more preferably, greater than or equal to (15/32)·λ and less than or equal to (17/32)·Further, taking the high dimension mode of the radiating element 22 into consideration, the electrical length Le22 of the radiating element 22 is preferably greater than or equal to (3/8)·λ·m and less than or equal to (5/8)·λ·m, more preferably greater than or equal to (7/16)·λ·m and less than or equal to (9/16)·λ·m, and yet more preferably greater than or equal to (15/32)·λ·m and less than or equal to (17/32)·λ·m. It is to be noted that "m" is a natural number that indicates the number of modes in a high dimension mode. It is preferable for "m" to be an integer of 1-5, and more preferably an integer of 1-3. The resonance of the radiating element 22 is a fundamental mode in a case where "m=1". If the electrical length Le22 is within the preferred range described above, the radiating element 22 can sufficiently function as a radiating conductor and the efficiency of the multiband antenna 1 can be satisfactory.

Similarly, in a case where the fundamental mode of the resonance of the radiating element 22 is a loop mode (a case where the radiating element is a loop-shaped conductor), the electrical length Le22 of the radiating element 22 is preferably greater than or equal to (7/8)·λ and less than or equal to (9/8)·λ, more preferably, greater than or equal to (15/16)·λ and less than or equal to (17/16)·λ, and yet more preferably, greater than or equal to (31/32)·λ and less than (33/32)·λ. In a case where the resonance of the radiating element 22 is a high dimension mode, the electrical length Le22 of the radiating element 22 is preferably greater than or equal to (7/8)·λ·m and less than or equal to (9/8)·λ more preferably greater than or equal to (15/16)·λ·m and less than (17/16)·λ and yet more preferably greater than or equal to (31/32)·λ·m and less than or equal to (33/32)·λ ·m.

It is to be noted that the physical length L22 of the radiating element 22 is determined according to "$\lambda_{g2}=\lambda_0 \cdot k_2$" in which "$\lambda_0$" indicates the vacuum wavelength of the resonance frequency of the fundamental mode of the radiating element 22 and "$k_2$" indicates the shortening rate of wavelength shortening caused by the environment in which the multiband antenna 1 is installed. In this example, "$k_2$ is a value calculated according to, for example, the dielectric constant, the magnetic permeability, the thickness, and the resonance frequency of the medium (environment) of the dielectric material including the feeding element 21 (e.g., the actual dielectric constant ($\in r_2$), and the actual magnetic permeability ($\mu r_2$). That is, in a case where the fundamental mode of the resonance of the radiating element 22 is a dipole mode, the physical length L22 of the radiating element 22 is ideally $(1/2)\cdot\lambda_{g2}$. More specifically, the physical length L22 of the radiating element 22 is preferably greater than or equal to $(1/4)\cdot\lambda_{g2}$ and less than or equal to $(5/8)\cdot\lambda_{g2}$, and more preferably, greater than or equal to $(3/8)\cdot\lambda_{g2}$ and less than or equal to $(5/8)\cdot\lambda_{g2}$. In a case where the fundamental mode of the resonance of the radiating element 22 is a loop mode, the physical length L22 of the radiating element 22 is greater than or equal to $(7/8)\cdot\lambda_{g2}$ and less than or equal to $(9/8)\cdot\lambda_{g2}$. The physical length L22 of the radiating element 22 is the physical length for providing the electrical length Le22. In an ideal case where no other element is included in the radiating element 22, the physical length L22 of the radiating element 22 is equal to the electrical length Le22. Even in a case where the physical length L22 is shortened by using a matching circuit such as an inductor, the physical length L22 is preferably greater than 0 and less than or equal to the electrical length Le22, and more preferably greater than or equal to 0.4 times the electrical length Le22 and less than or equal to 1 times the electrical length Le22. By adjusting the physical length L22 of the radiating element 22 in such manner, the operation gain of the radiating element 22 can be improved.

For example, in a case where a BT resin (registered trademark) CCL-HL870(M) (dielectric constant 3.4, tan $\delta$=0.003, substrate thickness=0.8 mm, manufactured by Mitubishi Gas Chemical Company Inc.) is used as a dielectric substrate, the physical length L21 of the feeding element 21 is 20 mm when the frequency designed for the radiating element 22 is 3.5 GHz, and the physical length L22 of the radiating element 22 is 34 mm when the frequency designed for the radiating element 22 is 2.2 GHz.

Further, in a case where the vacuum wavelength of a resonance frequency F of a fundamental mode of the radiating element 22 is "$\lambda_0$", the shortest distance between the feeding element 21 and the radiating element 22 (>0) is preferably less than or equal to $0.2\times\lambda_0$, more preferably less than or equal to $0.1\times\lambda_0$, and yet more preferably less than or equal to $0.05\times\lambda_0$. By positioning the feeding element 21 and the radiating element 22 apart from each other for a shortest distance of Dl, operation gain of the multiband antenna 1 can be improved.

It is to be noted that "shortest distance Dl" refers to the direct distance between the closest parts of the feeding element 21 and the radiating element 22. Further, feeding element 21 and the radiating element 22 may or may not intersect with each other from a Z-direction view as long as electromagnetic field coupling can be achieved. Further, in a case where the feeding element 21 and the radiating element 22 intersect from the Z-direction view, the intersecting angle between the feeding element 21 and the radiating element 22 may be discretionarily set.

Further, in a case where the feeding element 21 and the radiating element 22 are arranged extending alongside each other maintaining a shortest distance x therebetween, the length in which the feeding element 21 and the radiating element 22 extend is preferably less than or equal to ⅜ of the physical length of the radiating element 22, more preferably, less than or equal to ¼ of the physical length of the radiating element 22, and yet more preferably ⅛ of the physical length of the radiating element 22. The area maintaining the shortest distance x is to be an area where the coupling between the feeding element 21 and the radiating element 22 is strong. As the distance in which the feeding element 21 and the radiating element 22 are arranged alongside each other maintaining the shortest distance x becomes long, impedance matching becomes difficult because coupling becomes the feeding element 21 couples to both a high impedance part of the radiating element 22 and a low impedance part of the radiating element 22. Thus, from the standpoint of impedance matching, the length in which the feeding element 21 and the radiating element 22 maintain the shortest distance x is preferred to be short so that the feeding element 21 strongly couples only to a part of the radiating element 22 where there is little change of impedance.

In a case where the wavelength of the resonance frequency f of the fundamental mode of the radiating element 22 in vacuum is expressed as "$\lambda_0$", the wavelength shortening rate of a dielectric material in which the radiating element is provided is expressed as "$k_2$", and the wavelength on the dielectric material is expressed as "$\lambda=\lambda_0\cdot k$", the length L22 of the radiating element 22 is ideally $(1/2)\cdot\lambda_g$. The length L22 of the radiating element 22 is preferably greater than or equal to $(1/4)\cdot\lambda_g$ and less than or equal to $(5/8)\cdot\lambda_g$, and more preferably, greater than or equal to $(3/8)\cdot\lambda_g$ and less than or equal to $(5/8)\cdot\lambda_g$. By adjusting the length L22 of the radiating element 22 to such length, the operation gain of the radiating element 22 can be improved.

Further, the multiband antenna 1 is mounted on a wireless device (e.g., a wireless communication device such as a communication terminal that can be carried by a user). As examples of the wireless devices, there are electronic devices such as a data terminal, a portable telephone, a smartphone, a personal computer, a game device, a television, a music or video player.

For example, in a case where the multiband antenna 1 illustrated in FIG. 2 is mounted on a wireless communication device including a display, the resin substrate 45 may be a cover glass that entirely covers an image displaying surface of a display. Alternatively, the resin substrate 45 may be a housing (particularly, a front cover, a rear cover, a sidewall, etc.,) having the resin substrate 43 fixed thereto. The cover glass is a transparent or semi-transparent (transparent enough to be visible for the user) dielectric substrate for allowing an image to be displayed on a display. The cover glass is a planar member that is to be layered on the display.

In a case where the radiating element 22 is to be provided on a surface of the cover glass, the radiating element 22 may be formed by applying a conductive paste (e.g., copper, silver) on the surface of the cover glass and firing the conductive paste. The conductive paste used in this case may be a conductive paste that can be fired at a low temperature (low to the extent of not weakening the strength of the chemically strengthened glass used for the cover glass). Further, plating or the like may be applied for preventing the conductive material from degrading due to oxidization. Further, in a case where a black covering film is formed in the periphery of the cover glass to hide a wiring or the like, the radiating element 22 may be formed on the black covering film.

In a case of forming the radiating element 22 on the cover glass, the radiating element 22 is preferred to be shaped as a linear conductor. On the other hand, in a case where of forming the radiating element 22 on a housing, the area in which the radiating element 22 is to be formed is not limited in particular. Further, the shape of the radiating element 22 is not limited in particular. For example, the radiating element 22 may be a linear conductor, a loop conductor, or a patch-like conductor. In a case where the radiating element 22 is a patch-like conductor, the radiating element 22 may have a planar structure of various shapes such as a substantially quadrate shape, a substantially rectangular shape, a substantially circular shape, or a substantially elliptical shape.

Further, each of the feeding element 21, the radiating element 22, the non-feeding element 23, and the ground plane 42 may be positioned differently with respect to the height direction (direction parallel to the Z-axis). Alternatively, all of or a part of the feeding element 21, the radiating element 22, the non-feeding element 23, and the ground plane 42 may be positioned the same with respect to the height direction.

Further, a single feeding element 21 may be used to feed electric power to multiple radiating elements 22. The use of multiple radiating elements 22 facilitates the forming of multiband, the forming of wideband, or the controlling of directivity. Further, multiple multiband antennas 1 may be mounted on a single wireless device.

The S11 characteristic (FIGS. 3, 4, 5) in a case of performing simulation analysis on the multiband antenna 1 illustrated in FIGS. 1 and 2 is described. The S11 characteristic is one type of characteristic for high frequency electronic devices or the like. In this specification, the S11 characteristic is indicated by return loss (loss of response) with respect to frequency. A Microwave Studio (Registered Trademark) (CST Co. Inc.) is used as the electromagnetic field simulator. The resonance frequency of the fundamental mode of the radiating element 22 is set in the vicinity of 1 GHz.

In a case where units are indicated in millimeters, each of the dimensions illustrated in FIGS. 1 and 2 is as follows:

L1: 140
L2: 30
L3: 5.95
L4: 0.1
L5: 3.95 (FIG. 3), 5.95 (FIG. 4), 10.95 (FIG. 5)
L6: 15.95
L7: 95
L8: 40
L9: 120
H1: 0.8
H2: 1.72
H3: 1.0

The thickness (height) in the Z-axis direction is 0.018 mm for the ground plane 42, the feeding element 21, the radiating element 22, and the non-feeding element 23. Further, the width in the X-axis or Y-axis direction is 1.9 mm for the strip conductor 41, the feeding element 21, the radiating element 22, and the non-feeding element 23. Further, the resin substrate 43 is set with a dielectric constant of $\in_r$=3.4, tan δ=0.0015. The resin substrate 45 is set with a dielectric constant of $\in_r$=8.926, tan δ=0.000326.

Figure 3:
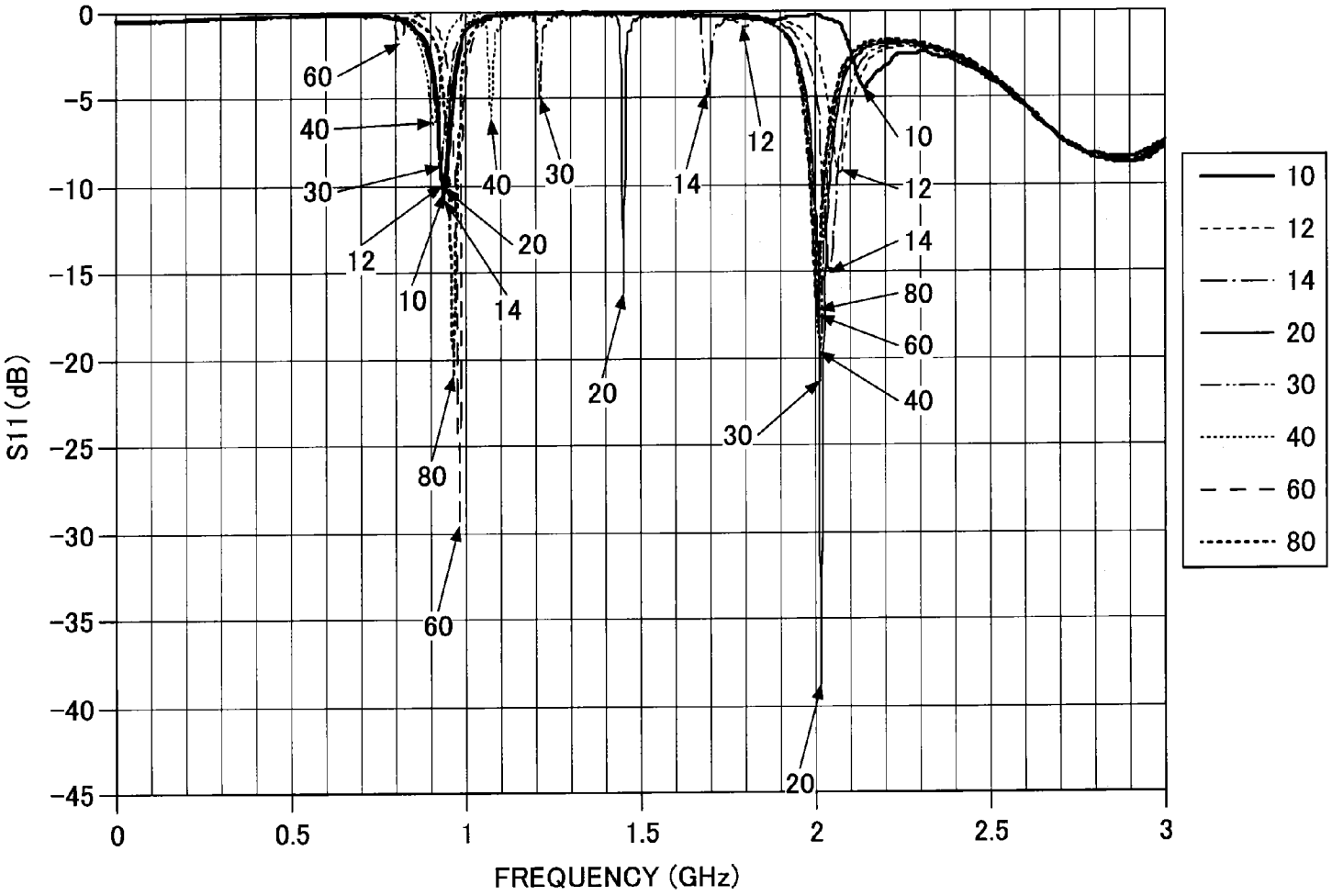
FIG. 3 is a graph illustrating an S11 characteristic of a multiband antenna when a reactance element only includes an inductance element (L5=3.95 mm, inductance=10 nH-80 nH)
Figure 4:
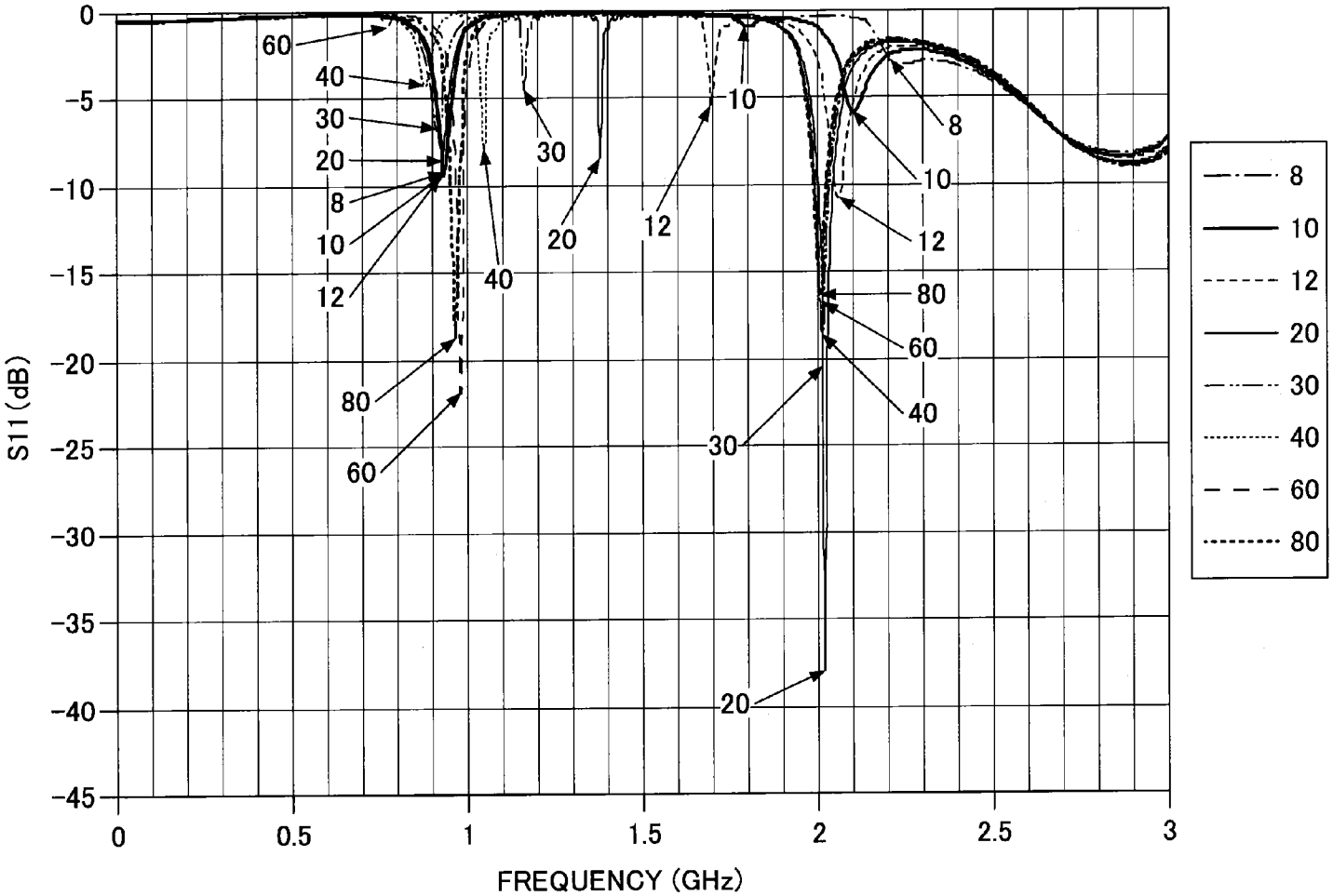
FIG. 4 is graph illustrating an S11 characteristic of a multiband antenna when a reactance element only includes an inductance element (L5=5.95 mm, inductance=8 nH-80 nH)
Figure 5:
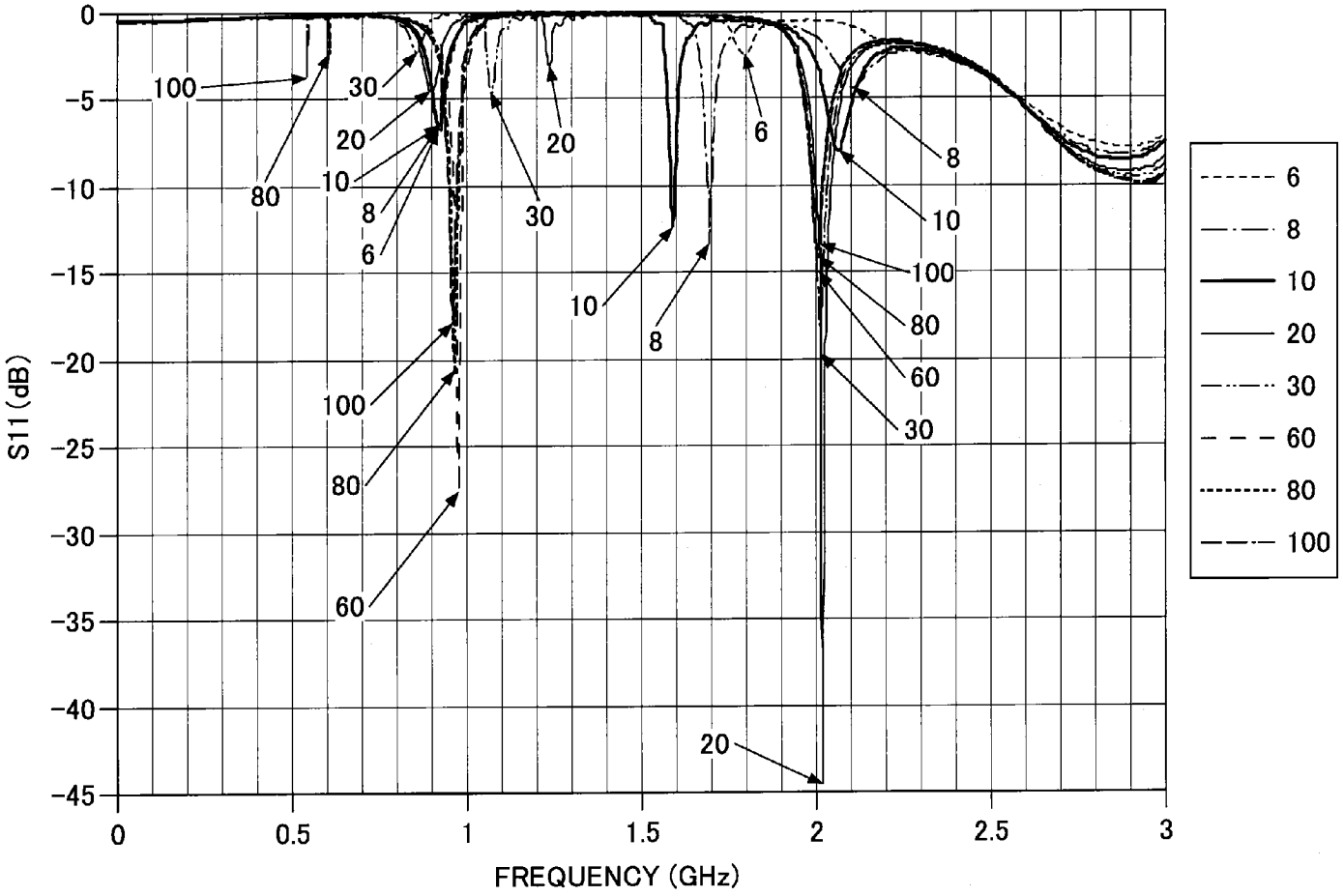
FIG. 5 is graph illustrating an S11 characteristic of a multiband antenna when a reactance element only includes an inductance element (L5=10.95 mm, inductance=6 nH-100 nH).

FIGS. 3-5 are schematic diagrams illustrating the S11 characteristic of the multiband antenna 1 in a case where the reactance element 24 includes only an inductance element. FIG. 3 illustrates the S11 characteristic of the multiband antenna 1 set with a L5 of 3.95 mm in a case where the inductance of the inductance element is changed from 10 nH to 80 nH. FIG. 4 illustrates the S11 characteristic of the multiband antenna 1 set with a L5 of 5.95 mm in a case where the inductance of the inductance element is changed from 8 nH to 80 nH. FIG. 5 illustrates the S11 characteristic of the multiband antenna 1 set with a L5 of 10.95 mm in a case where the inductance of the inductance element is changed from 6 nH to 100 nH. It is to be noted that "L5" is the length (in the X-axis direction) of a part where in the non-feeding element 23 and the radiating element 22 superpose from a plan view.

As illustrated in FIGS. 3-5, the resonance frequency of the fundamental mode of the multiband antenna 1 appears in the vicinity of 1 GHz, and the resonance frequency of the second order mode of the multiband antenna 1 appears in the vicinity of 2 GHz.

In the case of FIG. 3, by setting the inductance of the inductance element to 12 nH-60 nH, a new resonance frequency in a frequency band other than the frequency band of the resonance frequency (hereinafter also referred to as "additional resonance frequency") is added without changing the respective resonance frequencies of the preexisting fundamental mode and the second order mode. Further, in the case of FIG. 3, by setting the inductance of the inductance element to 12 nH-40 nH, a new resonance frequency between the preexisting fundamental mode and the second order mode (hereinafter also referred to as "intermediate resonance frequency") is added without changing the respective resonance frequencies of the preexisting fundamental mode and the second order mode.

In the case of FIG. 4, by setting the inductance of the inductance element to 10 nH-60 nH, the additional resonance frequency is added without changing the respective resonance frequencies of the preexisting fundamental mode and the second order mode. Further, in the case of FIG. 4, by setting the inductance of the inductance element to 10 nH-40 nH, an intermediate resonance frequency is added without changing the respective resonance frequencies of the preexisting fundamental mode and the second order mode.

In the case of FIG. 5, by setting the inductance of the inductance element to 8 nH-100 nH, the additional resonance frequency is added without changing the respective resonance frequencies of the preexisting fundamental mode and the second order mode. Further, in the case of FIG. 5, by setting the inductance of the inductance element to 8 nH-30 nH, an intermediate resonance frequency is added without changing the respective resonance frequencies of the preexisting fundamental mode and the second order mode.

Accordingly, by adjusting the inductance of the inductance element, the additional resonance frequency (or the intermediate resonance frequency) can be controlled. By increasing the inductance of the inductance element, the additional resonance frequency (or the intermediate resonance frequency) can be moved sequentially toward a low frequency side.

According to the above-described embodiments of the present invention, a new resonance characteristic can be added without affecting the resonance characteristic of each of the preexisting modes.

Although embodiments of a multiband antenna have been described above, the present invention is not limited to these embodiments, but variations and modifications may be made without departing from the scope of the present invention.

For example, although each of the feeding element 21, the radiating element 22, and the non-feeding element 23 illustrated in FIG. 1 is a linear conductor extending in a straight line, the feeding element 21, the radiating element 22, and the non-feeding element 23 may be linear conductors including a bent conductive part. For example, the feeding element 21, the radiating element 22, and the non-feeding element 23 may include an L-shape conductive part or a meander-shape conductive part. Further, the feeding element 21, the radiating element 22, and the non-feeding element 23 may be a linear conductor including a conductive part that is branched in the midstream of the linear conductor.

A stub or a matching circuit may be provided in the feeding element 21. Thereby, the area of the substrate in which the feeding element 21 takes up can be reduced.

Further, a transmission line to be connected to the feeding element 21 is not limited to a micro-strip line. For example, a strip line or a coplanar waveguide having a ground plane (i.e., a coplanar waveguide having a ground plane on an opposite side of its conductive surface) may be connected to the feeding element 21. The feeding element 21 and the feeding point 44 may be connected by way of various transmission lines such as those described above.

The invention claimed is:

1. A multiband antenna, comprising:

a feeding element connected to a feeding point;

a radiating element positioned apart from the feeding element such that the radiating element functions as a radiating conductor and is fed with electric power by electromagnetic coupling to the feeding element;

a reactance element having a reactance which causes the multiband antenna to match with a frequency other than a resonance frequency of a resonance mode of the radiating element;

a ground plane; and a non-feeding element positioned close to the radiating element and connected to the ground plane via the reactance element, wherein the feeding element is configured to resonate such that the feeding element feeds the electric power to the radiating element by the electromagnetic coupling caused by resonance of the feeding element.

2. The multiband antenna as claimed in claim 1, wherein the reactance element is configured to cause the multiband antenna to match with a frequency between a resonance frequency of a fundamental mode of the radiating element and a resonance frequency of a second order mode of the radiating element.

3. The multiband antenna as claimed in claim 2, wherein the reactance of the reactance element is greater than or equal to 8 nH and less than or equal to 100 nH.

4. The multiband antenna as claimed in claim 2, wherein the non-feeding element and the radiating element are positioned such that a shortest distance between the non-feeding element and the radiating element is less than or equal to $0.2\times\lambda_0$, where $\lambda_0$ is a wavelength of a resonance frequency of a fundamental mode of the radiating element in a vacuum.

5. The multiband antenna as claimed in claim 2, wherein the non-feeding element includes a part extending in a direction separating from the ground plane and a part superposing the radiating element in a plan view.

6. The multiband antenna as claimed in claim 2, wherein the radiating element has a physical length which is in a range of greater than or equal to $(1/4)\cdot\lambda_{g2}$ and less than or equal to $(5/8)\cdot\lambda_{g2}$ in a case where a fundamental mode of a resonance of the radiating element is a dipole mode, and which is in a range of greater than or equal to $(7/8)\cdot\lambda_{g2}$ and less than or equal to $(9/8)\cdot\lambda_{g2}$ in a case where the fundamental mode of the resonance of the radiating element is a loop mode, and a wavelength in the atmosphere is $\lambda_{g2}=\lambda_0\cdot k_2$, where $\lambda_0$ is a wavelength of the resonance frequency of the fundamental mode of the radiating element in a vacuum, and $k_2$ is a wavelength shortening rate at an atmosphere in which the radiating element is provided.

7. The multiband antenna as claimed in claim 2, wherein an electrical length Le21 that provides a fundamental mode of a resonance of the feeding element is less than or equal to $(3/8)\cdot\lambda$, where $\lambda$ is a wavelength of the feeding element or the radiating element in the resonance frequency of a fundamental mode of the radiating element, and an electrical length Le22 that provides the fundamental mode of the resonance of the radiating element is in a range of greater than or equal to $(3/8)\cdot\lambda$ and less than or equal to $(5/8)\cdot\lambda$ when the fundamental mode of the resonance of the radiating element is a dipole mode, and is in a range of greater than or equal to $(7/8)\cdot\lambda$ and less than or equal to $(9/8)\cdot\lambda$ when the fundamental mode of the resonance of the radiating element is a loop mode.

8. The multiband antenna as claimed in claim 2, wherein the feeding element and the radiating element are positioned such that a shortest distance between the feeding element and the radiating element is less than or equal to $0.2\times\lambda_0$, where $\lambda_0$ is a wavelength of a resonance frequency of a fundamental mode of the radiating element in a vacuum.

9. The multiband antenna as claimed in claim 2, wherein the feeding element includes a feeding part which feeds the electric power to the radiating element, the radiating element includes a lowest impedance part having the lowest impedance in a resonance frequency of a fundamental mode of the radiating element, and the feeding part is positioned in an area other than the lowest impedance part.

10. The multiband antenna as claimed in claim 1, wherein the reactance of the reactance element is greater than or equal to 8 nH and less than or equal to 100 nH.

11. The multiband antenna as claimed in claim 1, wherein the non-feeding element and the radiating element are positioned such that a shortest distance between the non-feeding element and the radiating element is less than or equal to $0.2\times\lambda_0$, where $\lambda_0$ is a wavelength of a resonance frequency of a fundamental mode of the radiating element in a vacuum.

12. The multiband antenna as claimed in claim 1, wherein the non-feeding element includes a part extending in a direction separating from the ground plane and a part superposing the radiating element in a plan view.

13. The multiband antenna as claimed in claim 1, wherein the radiating element has a physical length which is in a range of greater than or equal to $(1/4)\cdot\lambda_{g2}$ and less than or equal to $(5/8)\cdot\lambda_{g2}$ in a case where a fundamental mode of a resonance of the radiating element is a dipole mode, and which is in a range of greater than or equal to $(7/8)\cdot\lambda_{g2}$ and less than or equal to $(9/8)\cdot\lambda_{g2}$ in a case where the fundamental mode of the resonance of the radiating element is a loop mode, and a wavelength in the atmosphere is $\lambda_{g2}=\lambda_0\cdot k_2$, where $\lambda_0$ is a wavelength of the resonance frequency of the fundamental mode of the radiating element in a vacuum, and $k_2$ is a wavelength shortening rate at an atmosphere in which the radiating element is provided.

14. The multiband antenna as claimed in claim 1, wherein an electrical length Le21 that provides a fundamental mode of a resonance of the feeding element is less than or equal to $(3/8)\cdot\lambda$, where $\lambda$ is a wavelength of the feeding element or the radiating element in the resonance frequency of a fundamental mode of the radiating element, and an electrical length Le22 that provides the fundamental mode of the resonance of the radiating element is in a range of greater than or equal to $(3/8)\cdot\lambda$ and less than or equal to $(5/8)\cdot\lambda$ when the fundamental mode of the resonance of the radiating element is a dipole mode, and is in a range of greater than or equal to $(7/8)\cdot\lambda$ and less than or equal to $(9/8)\cdot\lambda$ when the fundamental mode of the resonance of the radiating element is a loop mode.

15. The multiband antenna as claimed in claim 1, wherein the feeding element and the radiating element are positioned such that a shortest distance between the feeding element and the radiating element is less than or equal to $0.2\times\lambda_0$, where $\lambda_0$ is a wavelength of a resonance frequency of a fundamental mode of the radiating element in a vacuum.

16. The multiband antenna as claimed in claim 1, wherein the feeding element includes a feeding part which feeds the electric power to the radiating element, the radiating element includes a lowest impedance part having the lowest impedance in a resonance frequency of a fundamental mode of the radiating element, and the feeding part is positioned in an area other than the lowest impedance part.

17. The multiband antenna as claimed in claim 1, wherein the feeding element includes a feeding part which feeds the electric power to the radiating element, the radiating element includes a lowest impedance part having the lowest impedance in a resonance frequency of a fundamental mode of the radiating element, and the feeding part is separated from the lowest impedance part by a distance which is greater than or equal to ⅛ of an entire length of the radiating element.

18. The multiband antenna as claimed in claim 1, wherein the feeding element and the radiating element are positioned such that the feeding element and the radiating element are extending alongside each other and maintaining a shortest distance between the feeding element and the radiating element in a length of less than or equal to ⅜ of a length of the radiating element.

19. The multiband antenna as claimed in claim 1, wherein the feeding element extends in a direction separating from the ground plane, and the radiating element includes a part extending along an edge part of the ground plane.

20. A wireless device, comprising:

the multiband antenna of claim 1.

* * * * *